United States Patent [19]

Anderson et al.

[11] Patent Number: 4,770,608

[45] Date of Patent: Sep. 13, 1988

[54] FILM COOLED VANES AND TURBINES

[75] Inventors: Leon R. Anderson, Tequesta; Thomas A. Auxier, Lake Park, both of Fla.

[73] Assignee: United Technologies Corporation, Hartford, Conn.

[21] Appl. No.: 812,108

[22] Filed: Dec. 23, 1985

[51] Int. Cl.[4] ..... F01D 5/18

[52] U.S. Cl. ..... 416/97 R; 415/115

[58] Field of Search ..... 416/97 R, 96 R, 96 A, 416/97 A; 415/115

[56] References Cited

U.S. PATENT DOCUMENTS

| | | | |
|---|---|---|---|
| 2,220,420 | 11/1940 | Meyer | 416/235 X |
| 3,527,543 | 9/1970 | Howald | 416/97 R X |
| 3,533,711 | 10/1970 | Kercher | 416/97 R X |
| 3,540,811 | 11/1970 | Davis | 416/97 R X |
| 3,542,486 | 11/1970 | Kercher et al. | 416/97 R X |
| 3,644,059 | 2/1972 | Bryan | 416/97 A X |
| 3,799,696 | 3/1974 | Redman | 416/97 R |
| 3,801,218 | 4/1974 | Moore | 416/97 R |
| 3,930,748 | 1/1976 | Redman et al. | 416/97 A |
| 4,025,226 | 5/1977 | Hovan | 416/97 A X |
| 4,026,659 | 5/1977 | Freeman | 415/115 |
| 4,063,851 | 12/1977 | Weldon | 416/96 A X |
| 4,118,146 | 10/1978 | Dierberger | 416/97 A |
| 4,135,855 | 1/1979 | Peill | 416/96 A X |
| 4,168,938 | 9/1979 | Dodd | 416/97 R |
| 4,183,716 | 1/1980 | Takahara et al. | 416/96 A |
| 4,221,539 | 9/1980 | Corrigan | 415/115 X |
| 4,312,624 | 1/1982 | Steinbauer et al. | 415/115 |
| 4,505,639 | 3/1985 | Groess et al. | 416/97 R |
| 4,507,051 | 3/1985 | Lesgourgues et al. | 416/97 R |
| 4,565,490 | 1/1986 | Rice | 416/97 R X |
| 4,601,638 | 7/1986 | Hill et al. | 416/97 R |

FOREIGN PATENT DOCUMENTS

| | | | |
|---|---|---|---|
| 104507 | 8/1980 | Japan | 416/97 A |

*Primary Examiner*—Everette A. Powell, Jr.

*Attorney, Agent, or Firm*—Norman Friedland

[57] ABSTRACT

The film of cooling air adjacent the outer surface of the airfoil of a turbine of a gas turbine engine issuing from internally of the turbine subsequent to cooling is controlled by regulating the pressure ratio of the internal to external pressures by forming an internal chamber extending longitudinally in the turbine and having fixed orifices admitting cooling air therein bearing a predetermined relationship to the exit orifices forming the film of cooling air. By regulating this pressure ratio the diameter of the exit holes can be longer than heretofore designs for a given application so that they can be precast rather than drilled and can be arranged to give fuller coverage of films of cooling air on the outer surface of the airfoil.

3 Claims, 1 Drawing Sheet

FILM COOLED VANES AND TURBINES

DESCRIPTION

1. Technical Field

This invention relates to gas turbine engines and particularly to the cooling aspect of the turbine and vanes.

2. Background Art

As is well known, the turbine and its associated stator vanes operate in an extremely hostile environment of the gas turbine engine. It is equally well known that the temperature at which the turbine operates has a direct relationship to the efficiency of the engine, the higher the temperature the higher the efficiency. Obviously, those involved in gas turbine technology have continuously strived to operate the turbine at higher temperature, either by the materials utilized or by cooling techniques.

For example, the airfoils in the turbines of such engines may see temperatures in the working gases as high as 2,500° F. (Twenty-Five Hundred degrees Fahrenheit). The blades and vanes of these engines are typically cooled to preserve the structural integrity and the fatigue life of the airfoil by reducing the level of thermal stresses in the airfoil.

One early approach to airfoil cooling is shown in U.S. Pat. No. 3,171,631 issued to Aspinwall entitled "Turbine Blade". In Aspinwall, cooling air is flowed to the cavity between the suction sidewall and the pressure sidewall of the airfoil and diverted to various locations in the cavity by the use of turning pedestals or vanes. The pedestals also serve as support members for strengthening the blade structure.

As time passed, more sophisticated approaches employing torturous passages were developed as exemplified in the structure shown in U.S. Pat. No. 3,533,712 issued to Kercher entitled "Cooled Vanes Structure for High Temperature Turbines". Kercher discloses the use of serpentine passages extending throughout the cavity in the blade to provide tailored cooling to different portions of the airfoil. The airfoil material defining the passages provides the necessary structural support to the airfoil.

Later patents such as U.S. Pat. No. 4,073,599 issued to Allen et al entitled "Hollow Turbine Blade Tip Closure" disclose the use of intricate cooling passages coupled with other techniques to cool the airfoil. For example, the leading edge region in Allen et al is cooled by impingement cooling followed by the discharge of the cooling air through a spanwisely extending passage in the leading edge region of the blade. The flowing air in the passage also convectively cools the leading edge region as did the passage in Aspinwall.

The cooling of turbine airfoils using intricate cooling passages having multiple passes and film cooling holes alone or in conjunction with trip strips to promote cooling of the leading edge region are the subject of many of the latest patents such as: U.S. Pat. No. 4,177,010 issued to Greaves et al entitled "Cooled Rotor Blade for a Gas Turbine Engine" (film cooling holes); U.S. Pat. No. 4,180,373 issued to Moore et al entitled "Turbine Blade" (film cooling holes and trip strips); U.S. Pat. No. 4,224,011 issued to Dodd et al entitled "Cooled Rotor Blade for A Gas Turbine Engine" (film coolng holes); and U.S. Pat. No. 4,278,400 issued to Yamarik et al entitled "Coolable Rotor Blade" (film cooling holes and trip strips). These blades are typified by large cooling air passages in relation to the thickness of the walls in the leading edge region of the blade.

The main internal heat transfer mechanism in the passages of multipass blades is convective cooling of the abutting walls. Zones of low velocity in the cooling air which is adjacent the walls defining the passage reduce the heat transfer coefficients in the passage and may result in over temperaturing of these portions of the airfoil. U.S. Pat. No. 4,180,373 issued to Moore et al entitled "Turbine Blade" employs a trip strip in a corner region of a turning passage which projects from a wall into the passage to prevent stagnation at the corner formed by the interaction of adjacent walls.

Obviously, one of the considerations in designing the modern multipass, film cooled turbine airfoil cooling scheme is to ensure that hot gases from the gas path will not flow internally of the airfoil at some critical location that is determined by the lowest acceptable value of the internal-to-external pressure ratio.

For example, in existing first stage turbine the internal and external pressures at film cooling injection sites measured large variations of internal/external ratios. Obviously, the lowest value of internal-to-external pressure ratio exists at the pressure surface in the fifth pass (in the particular construction tested) and all other internal pressures are set by the choice of this lowest value. External pressures are set by the combination of selected flowpath and airfoil aerodynamics. Little can be done to change external pressure levels without compromising aerodynamic efficiency of the turbine, especially in the sense of location-to-location around the external surface of the airfoil. The same is true of internal pressure levels with the channel-type circuitry shown in the prior art.

DISCLOSURE OF INVENTION

The object of this invention is to regulate the local internal pressure regulation at the film-cooling injection sites of the blades of a gas turbine engine so as to produce a pressure drop across the regulating internal orifice (internal of the blades) to achieve a desired pressure ratio to obtain the best possible film cooling at the outer surface of the blading.

A feature of this invention is to provide an internal longitudinal closed channel adjacent the inner surface of the blading so as to feed the channel with cooling air having the desired pressure by flowing the cooling air first through a fixed predetermined sized orifice and a second predetermined orifice for forming a film of cooling air. The pressure ratio can be controlled so as to increase the number of exit openings and enhance the film cooling effectiveness.

Other features and advantages will be apparent from the specification and claims and from the accompanying drawings which illustrate an embodiment of the invention.

BEST MODE FOR CARRYING OUT THE INVENTION

While in its preferred embodiment, this invention will be described as applied to a turbine blade of a gas turbine engine, it will be understood that as one skilled in the art will appreciate, it would have other applications, as for example, in vanes.

Figure 1:
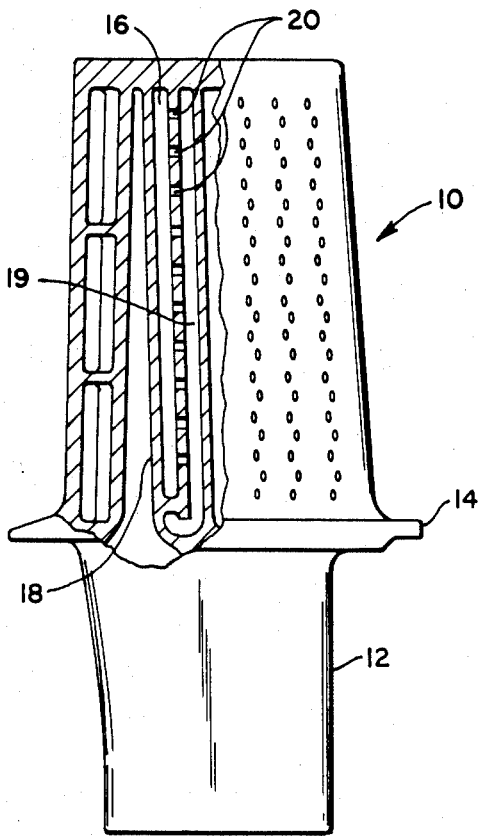
FIG. 1 is a view partly in elevation and partly in section showing a state-of-the-art five pass internal cooled turbine blade modified to include the invention with a single channel.

As shown in FIG. 1, the turbine blade generally indicated by reference numeral 10 comprises a root section 12, a platform section 14 and an airfoil section 16. The operation of the turbine blade and the various cooling techniques are well described in the prior art and for the sake of simplicity and convenience, only that portion of the blade and its cooling techniques that apply to this invention will be described herein. For further details of cooling techniques reference should be made to the patents referred to above and particularly to U.S. Pat. No. 4,474,532, supra and U.S. Pat. No. 3,527,543 granted to W. E. Howard on Sept. 8, 1970, all of which are incorporated herein by reference. As viewed from the pressure side, the internal portion of the blade has formed therein, as by casting, a channel 16 formed by a cylindrical wall 18 extending in the longitudinal direction of the blade which is entirely enclosed. A portion of wall 18 will include the outer surface of the airfoil section (as will be more clearly seen in FIG. 2). As is apparent from FIG. 1, the channel 16 is in communication with pass 18 through a plurality of predetermined sized holes 20. Pass 18 would be one and preferrably the last pass of multiple passes as is typical in turbine cooled blades discussed in the prior art noted above.

Figure 2:
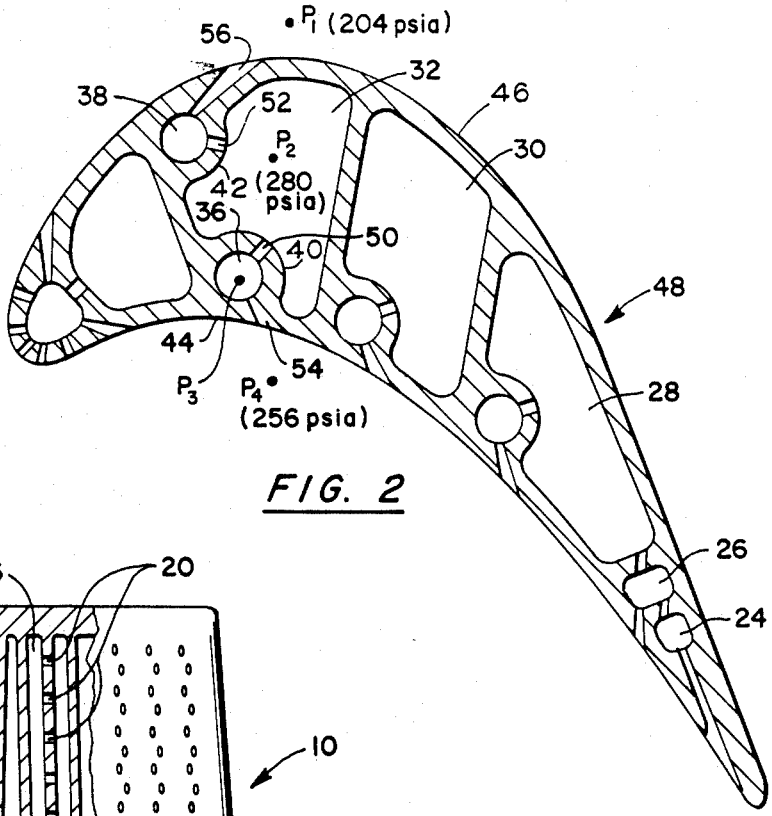
FIG. 2 is a sectional view of a turbine blade showing the invention with multiple channels.

The section taken along the chordwise direction of the blade as illustrated in FIG. 2 better shows the relationship of the film cooling holes and the regulated pressure in the channels. As noted, FIG. 2 is a different configuration than the configuration shown in FIG. 1, but the principles of the invention in both are the same.

The configuation of FIG. 2 is a five pass internal cooling structure consisting of passes 24, 26, 28, 30 and 32. For the sake of simplicity and convenience, only the pass 32 will be described herein but the invention applies equally to all the other passes. As was described with reference to FIG. 1, channels are cast internally of the blade, and channels 36 and 38 being illustrative of two of the plurality of channels. The walls 40 and 42 are formed adjacent the pressure surface 44 and suction surface 46 of the blade 48 to define therewith the respective channels. The holes 50 and 52 are sized to provide a fixed restriction to give a predetermined pressure drop $P_3$-$P_2$. Also the size of the film cooling holes 54 and 56, which may be of the diffused type, is also predetermined.

By preselecting the size of the holes 50 and 54 and 52 and 56 the local pressure or the pressures in channels 36 and 38, respectively, can be regulated to provide efficacious film cooling.

By virtue of this invention, by placing holes 50 in series with holes 54 which creates the regulated pressure in chamber 36, it is possible to double the number of film cooling holes that it would require to deliver the same amount of cooling flow if the internal-to-external pressure ratio were $P_1/P_3$ rather than $P_2/P_3$.

Figure 3B:
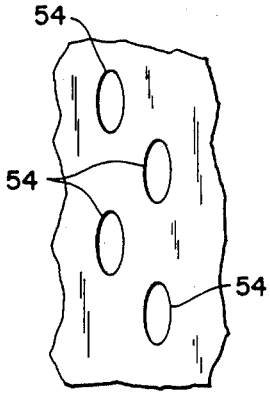
FIGS. 3A and 3B are partial views showing the portion of the surface of the pressure side of a turbine blade in section and the front view showing the arrangement of the film cooling holes located in a pattern that increases the number of holes over the prior art.
Figure 3A:
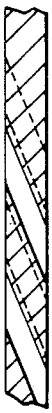

FIG. 3 illustrates how the pressure side of the blade can accommodate double the number of film cooling holes than would otherwise be achieved without the addition of this invention. As noted the diffused row of holes 54 are staggered, whereas in the heretofore design only a single row would accommodate the same amount of cooling flow.

Moreover, because of the more effective cooling for the same cooling flow, this invention provides improved manufacturing techniques. For blades that use significant amounts of cooling air for blade film cooling, as is the case of the more advanced turbine power plants, in order to keep cooling flows at competitive levels these designs require numerous small holes. Today's casting technology can cast holes in the 0.02 to 0.025" range. However, the modern blade designs require much smaller holes in the 0.014" diameter range. Since these sized holes cannot be cast, they must be drilled with 40% to 50% extra cost added to the price of the blade. The pressure regulator of this invention allows for increased film hole size to the casting range of 0.02" to 0.03" without a sacrifice in cooling flow requirements or life when compared to current technology blades. That is to say, one 0.014" hole restriction is replaced by two castable 0.02" hole restrictions. By casting in the film holes this invention will reduce the cost of a turbine blade 40% to 50% with no loss in cooling or system performance.

By virtue of this invention the regulated local internal pressure levels, in addition to the advantages discussed above, and without limitations, provide (1) improved performance by reducing the required coolant flow for a specific blade design, (2) increases the life of the blade because of the reduced metal temperature or in the alternative allows the turbine to operate at an increased value, which increases the overall engine efficiency.

It should be understood that the invention is not limited to the particular embodiments shown and described herein, but that various changes and modifications may be made without departing from the spirit and scope of this novel concept as defined by the following claims.

We claim:

1. A turbine of a gas turbine engine having an airfoil section including means for internal cooling with air, an enclosed passage formed longitudinally within the airfoil section, said airfoil section having a first wall defining the pressure surface and a second wall defining the suction surface, said enclosed passage having a longitudinal portion sharing a common portion of either said first wall or said second wall, a plurality of apertures in said common portion for issuing air adjacent either said pressure surface or said suction surface for forming a film of cooling air adjacent said pressure surface or said suction surface and at least one fixed orifice in said enclosed passage for admitting cooling air therein and being dimensioned to provide a predetermined pressure ratio between said pressure internally of said passage and externally of said airfoil section and being in serially flow relationship with said plurality of apertures.

2. For a turbine as claimed in claim 1 including a plurality of fixed orifices spaced longitudinally along said enclosed passage.

3. For a turbine as in claim 2 wherein said enclosed passage is defined by a cylindrically-shaped wall.

* * * * *